US006401573B2

(12) United States Patent
McClure

(10) Patent No.: US 6,401,573 B2
(45) Date of Patent: Jun. 11, 2002

(54) MULTIPURPOSE TOOL FOR GRIPPING CYLINDRICAL OBJECTS

(76) Inventor: Travis McClure, 429 -9th Ave., Kirkland, WA (US) 98033

( * ) Notice: Subject to any disclaimer, the term of this patent is extended or adjusted under 35 U.S.C. 154(b) by 0 days.

(21) Appl. No.: 09/804,685

(22) Filed: Mar. 12, 2001

Related U.S. Application Data

(63) Continuation-in-part of application No. PCT/US99/20706, filed on Sep. 10, 1999.

(51) Int. Cl.[7] ..... B25B 21/00
(52) U.S. Cl. ..... 81/58; 81/90.1; 81/120
(58) Field of Search ..... 81/90.1, 90.2, 81/90.3, 120, 58, 128, 441, 451–455

(56) References Cited

U.S. PATENT DOCUMENTS

| | | | | | |
|---|---|---|---|---|---|
| 1,875,484 | A | * | 9/1932 | Nigra | 81/441 |
| 2,402,353 | A | | 6/1946 | Trautmann | 488/421 |
| 2,477,891 | A | | 8/1949 | O'Neill | 714/313 |
| 3,471,160 | A | * | 10/1969 | Sabo | 81/441 X |
| 4,762,030 | A | * | 8/1988 | Nguyen | 81/55 |
| 4,862,773 | A | * | 9/1989 | Batten | 81/55 |
| 5,095,779 | A | * | 3/1992 | Batten | 81/55 |
| 5,182,973 | A | * | 2/1993 | Martindell | 81/438 X |
| 5,438,891 | A | * | 8/1995 | Batten | 81/56 |
| 5,795,110 | A | | 8/1998 | Wirth, Jr. et al. | 408/110 |
| 5,819,611 | A | * | 10/1998 | Kozak | 81/453 X |
| 5,882,151 | A | | 3/1999 | Wirth, Jr. et al. | 408/110 |
| 5,997,010 | A | | 12/1999 | Lloyd | 279/2.03 |

* cited by examiner

*Primary Examiner*—Joseph J. Hail, III
*Assistant Examiner*—Anthony Ojini
(74) *Attorney, Agent, or Firm*—Graybeal Jackson Haley LLP

(57) ABSTRACT

A tool to grip the outer periphery of an object being adaptable, for example, to remove a collar locked to the threaded shaft of a frangible fastener or operate as a drill stop. The tool includes an outer cylinder having a threaded portion and an inner cylinder having complementary threaded portion. A collet is disposed in the volume defined by the outer cylinder and is positioned to receive an axial force from the inner cylinder when translated via rotation with respect to the outer cylinder. The collet has a segment removed to permit the collet to decrease in size upon application of a constrictive radial force. The collet further has a frusto-conical outer surface that acts upon a complementary surface on the inner portion of the outer cylinder. When the collet is acted upon by the inner cylinder, a compressive radial force is applied thereto, which results in the collet constricting to securely and nearly uniformly grasp any object located within the collet. If adapted for use as a drill stop, an end stop can be rotatably coupled to the outer cylinder to prevent unintentional damage to the material being drilled.

20 Claims, 7 Drawing Sheets

MULTIPURPOSE TOOL FOR GRIPPING CYLINDRICAL OBJECTS

This application claims benefit under 35 USC §120 as a Continuation-In-Part of co-pending application PCT/US99/20706, filing date Sep. 9, 1999 designating the United States.

TECHNICAL FIELD

The invention relates to a multipurpose tool for gripping cylindrical objects in a manufacturing environment, and more particularly to such a tool that can be used to grip cylindrical fasteners and drill bits.

BACKGROUND OF THE INVENTION

Frequently, it is desired to grip a cylindrical object to impart rotation thereto, to prevent rotation thereof or to maintain the relative position of the gripping tool to the object. Most solutions rely upon a multi-component apparatus that utilizes radially moveable jaws, or constriction wrenches that employ a band or the like.

One area that relies upon a need to grip cylindrical objects relates to the field of locking collar fastener systems. These systems, sometimes called a frangible fastener or "HI-LOK" systems, are used in environments of high vibration, such as on aircraft, to join two parts together. A locking collar fastener system is used wherever a rivet can be used to join parts together. The frangible fastener system utilizes a first piece comprising a threaded shaft on one end and an exposed retaining ring at the other end. A passage is drilled through the parts to be fastened typically large sheets of metal such as aircraft surfaces and boats. The threaded shaft portion of the fastener is inserted through the aligned passages to the exposed retaining ring. Often the surface of the part to be fastened is indented at the hole consistent with the retaining ring to provide a flat outer surface at the area of the retainer ring. A matching threaded locking collar is hand rotated upon the threaded portion of the shaft, then controllably torqued with a wrench. The threaded locking collar joins to a wrenching ring by a notched neck, which shears from the collar at a predetermined torsional loading during the torquing. The threaded locking collar having an upset portion, usually a slightly elliptical shape, provides a frictional spring lock to prevent the locking collar from un-treading or loosening, even in environment of high vibration and stress. The collar remains locked to the fastener shaft even when the residual tension on the fastener is lost.

The removal of the HI LOK and other frangible fasteners without damage to the part attached often presents a challenging problem but is needed for many useful reasons. On the HI LOK type frangible fastener, an hexagonal opening at the end of the shaft of the locking collar fastener is sufficiently recessed in depth to receive a standard allen wench for the purpose of retaining the shaft in position with respect to the locking collar during removal.

The removal of the locked collar from the shaft is usually difficult, but necessary for repair and maintenance of the joined parts. To accomplish this, heretofore, drilling means such as a drill bit manual, electric or air-motor are used to drill out the center of the shaft portion or a cutting means such as a hack-saw is used to cut the collar. In either case, this activity weakens the fastener. Then the parts of the collar are pried, chiseled or twisted off to expose the shaft portion of the fastener within the passage. Then a knock-out pin is used to force the shaft from the passage. The problem with this method is the time it takes to drill or cut and manipulate the collar in order to expose then remove the shaft from the passage. Furthermore, scars from the removal operations and consequential weakening to the parts surrounding the passage may create problems in refastening the parts using the same passage.

Ongoing efforts have been made to improve the means to remove these types of fasteners without causing damage. Such efforts have been addressed both to the general object of improving the manner of removal of the frangible fasteners as well as the speed that these fasteners may be removed without damage to the parts fastened. Because the frangible fasteners are designed to hold parts together in environments involving extreme stress and vibration, no universally adaptable tool was known to address the removal of frangible fasteners without encountering the difficulties noted above.

In addition to the foregoing, another area wherein gripping of a cylindrical object is desired relates to drill stops. Conventional technologies have traditionally relied upon a collar sized to fit about the drill bit and held in place by a set screw at a precise location on the drill bit. Because the act of drilling involves the use of substantially axial pressure on the drill bit to advance the same through the material being drilled, such stops often encounter impact forces when the drill bit passes through the material. The result is that the stop stops forward momentum. However, because the stop has only one point of contact, i.e., the set screw, these stops are often displaced from their precise location on the bit. Efforts to overcome this consequence have relied upon progressively slowing the forward momentum by using a compression spring located between the stop and the material. This solution, however, does not eliminate the problem entirely. Moreover, the set screw may not reside on a land, or may otherwise be damaged by the bit, or damage the bit.

SUMMARY OF THE INVENTION

The invention is directed in part to a tool for grasping cylindrical objects within a given diameter range, which have an exposed end. The tool comprises an outer cylinder, an inner cylinder, and a collet, which interacts between the two cylinders whereby the internal diameter of the collet is affected. The outer cylinder has a first end, a second end, an outer surface and an inner surface wherein the inner surface includes a threaded portion and a frusto-conical portion. The inner cylinder havs a first end, a second end, an outer surface and an inner surface wherein the outer surface includes a threaded portion adapted to engage the outer cylinder threaded portion. The collet is sized to fit within the outer cylinder and has a first end, a second end, an outer surface and an inner surface wherein the outer surface has a generally frusto-conical profile generally complementary to the outer cylinder frusto-conical portion. The collet further defines a gap extending from the outer surface to the inner surface, and from the first end to the second end. When presented with a radially compressive force, the gap dimension of the collet is modified thereby causing radial constriction of the collet around the cylindrical object when placed within the boundaries of the collet inner surface.

In a preferred embodiment, the inner cylinder threaded portion engages the outer cylinder threaded portion to enable the inner cylinder to occupy the inner volume defined by the outer cylinder. When the collet is placed in the internal boundaries of the outer cylinder, the outer surface of the collet, which is preferably a frusto-conical or tapered form, contacts the frusto-conical or tapered portion of the outer cylinder; an upper rim portion of the collet then contacts the second end or lower area of the inner cylinder. As the inner cylinder is rotated so as to progressively occupy the inner volume defined by the outer cylinder, the collet is urged towards the reduced diameter portion of the outer cylinder, thereby subjecting the collet to radial compression. In turn, this radial compression will cause the collet to grip any cylindrical object placed therein.

Depending upon application, the basic tool can be adapted to serve numerous functions. As previously described, the tool can be used to assist in the removal of frangible fasteners, or can be used as a drill stop. If a drill stop is desired, a preferred embodiment further comprises an end stop that is rotationally mounted to the second or lower end of the outer cylinder so that any contacted material encountered during drilling operations will not be subject to rotational abrasion. Advantageously, the collet provides nearly uniform radial compression over the entire surface contacting with the bit.

DETAILED DESCRIPTION OF THE INVENTION

Figure 1:
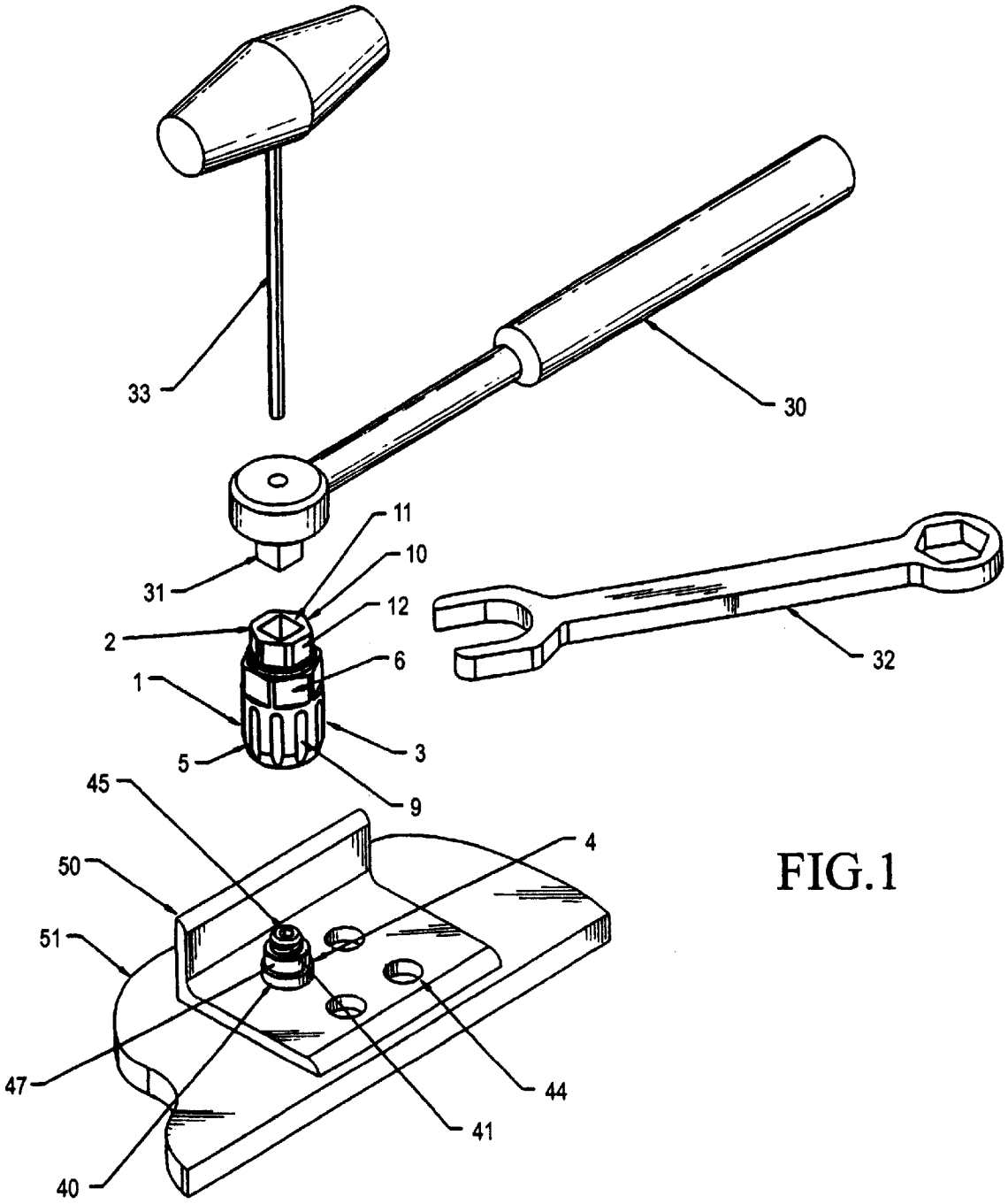
FIG. 1 is a perspective view of the gripping tool in relationship to a frangible fastener, other tools used with the gripping tool.

Referring then to the several Figures wherein like numerals indicate like parts, a locking collar removal tool is first shown in FIGS. 1–7. Referring specifically to FIG. 1, a locking collar removal tool 1 features a recess 11 to receive a standard ratchet or wrench prong 31 of a ratchet wrench 30 or similar levered tool outlined in this FIG. 1 and a set of standard hexagonal faces 12 around the circumference of the head portion 10 of the inner cylinder 2 to receive a standard open or closed head wrench 32. The head portion 10 of the inner cylinder 2 of the removal tool is conveniently torqued with either wrench 30 or 32.

The typical HI LOK or collar fastener 4 has a shaft 42 with a recess 45 for hexagonal shaped allen wrenches 33 at a collar end. The length of the shaft could be of various lengths depending on the thickness of the parts 50 and 51 joined. The fastener system comprises a threaded portion 41 of the shaft 42, a collar 40, a retaining ring 43 and a locking upset portion 47 tapered at 27 to a bottom portion 48. The retaining ring 43 may have a beveled other end to permit the head of the retaining ring 43 to fit smoothly along the surface of part 51.

Figure 5:
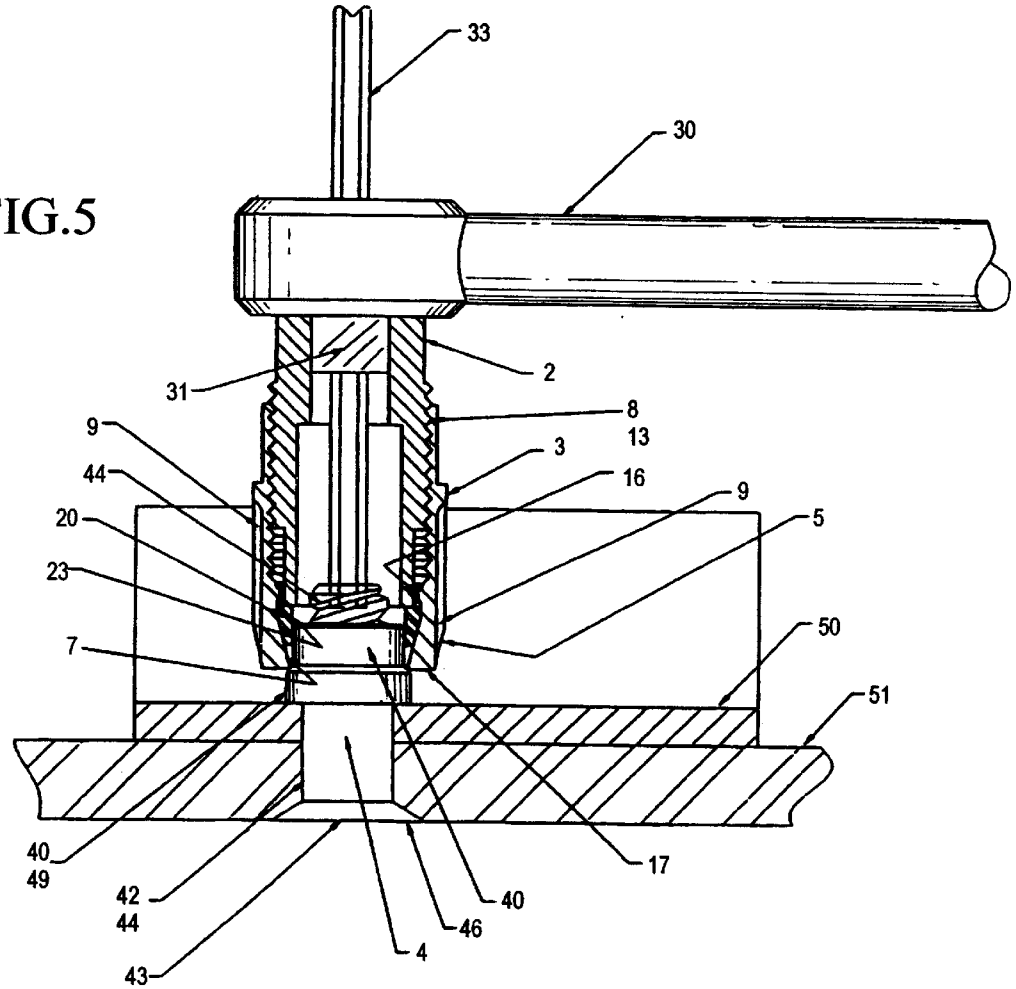
FIG. 5 is a partial cross sectional side elevation of the gripping tool in use.
Figure 6:
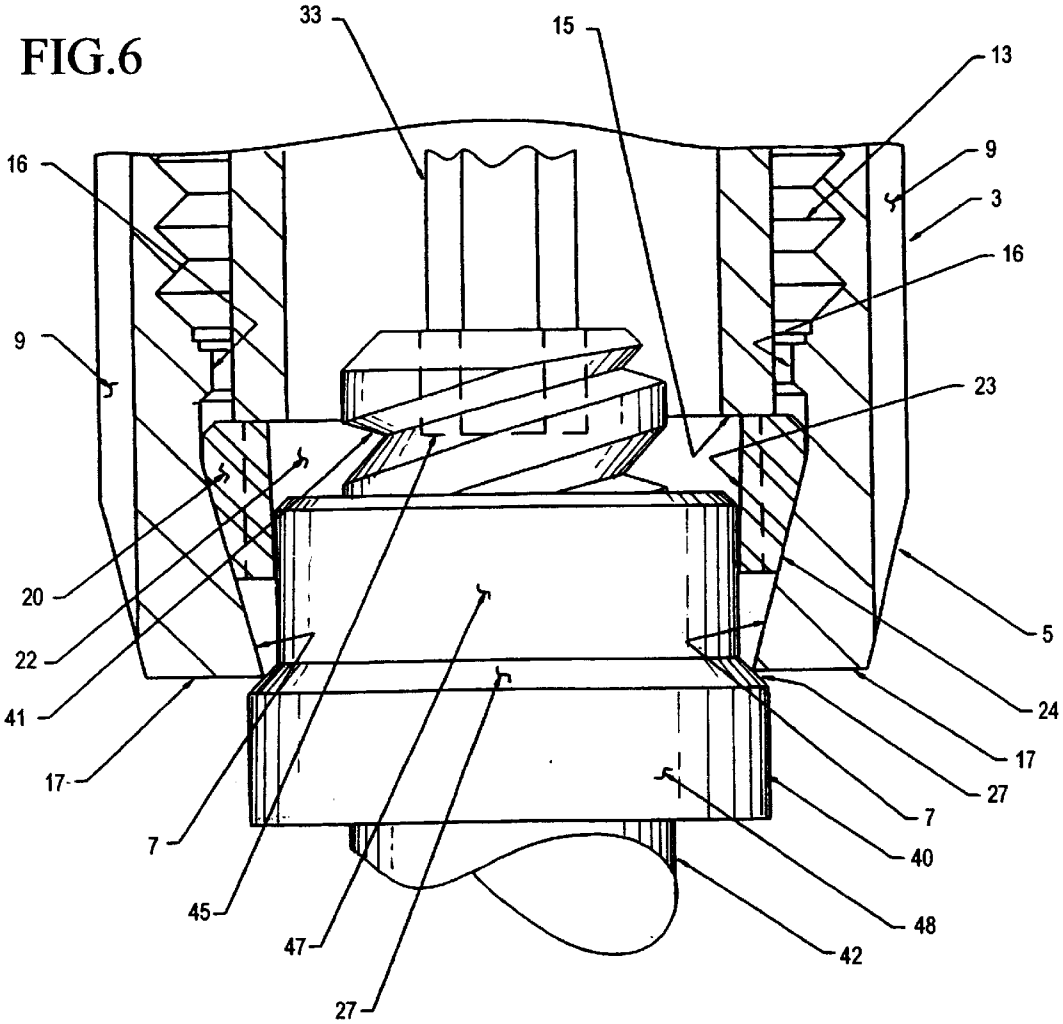
FIG. 6 is a detailed illustration of the gripping tool used in conjunction with the frangible fastener.

The parts 50 and 51 were fastened by placing the shaft 42 of fastener 4 within aligned passages 44, the shaft 42 inserted through up to the retaining ring 43 at the end of the fastener 4. FIG. 5 shows the surface of part 51 cut away to permit the beveled portion of the fastener retaining ring to seat therein. A locking collar 40 with wrenching ring (not shown) was then torqued on the threaded portion of the shaft, the collar 40 moving along the threaded portion of the shaft to the part 50. Further torquing then compressed part 50 to 51 to a pre-determined shear torquing load that breaks the wrenching ring portion (not shown) from the collar, somewhat distorting the collar 40 leaving a locking upset portion 47 but resulting in a very strong fastener 4 holding the parts 50 and 51, with only the collar 40 and upset portion 47 exposed.

Figure 2:
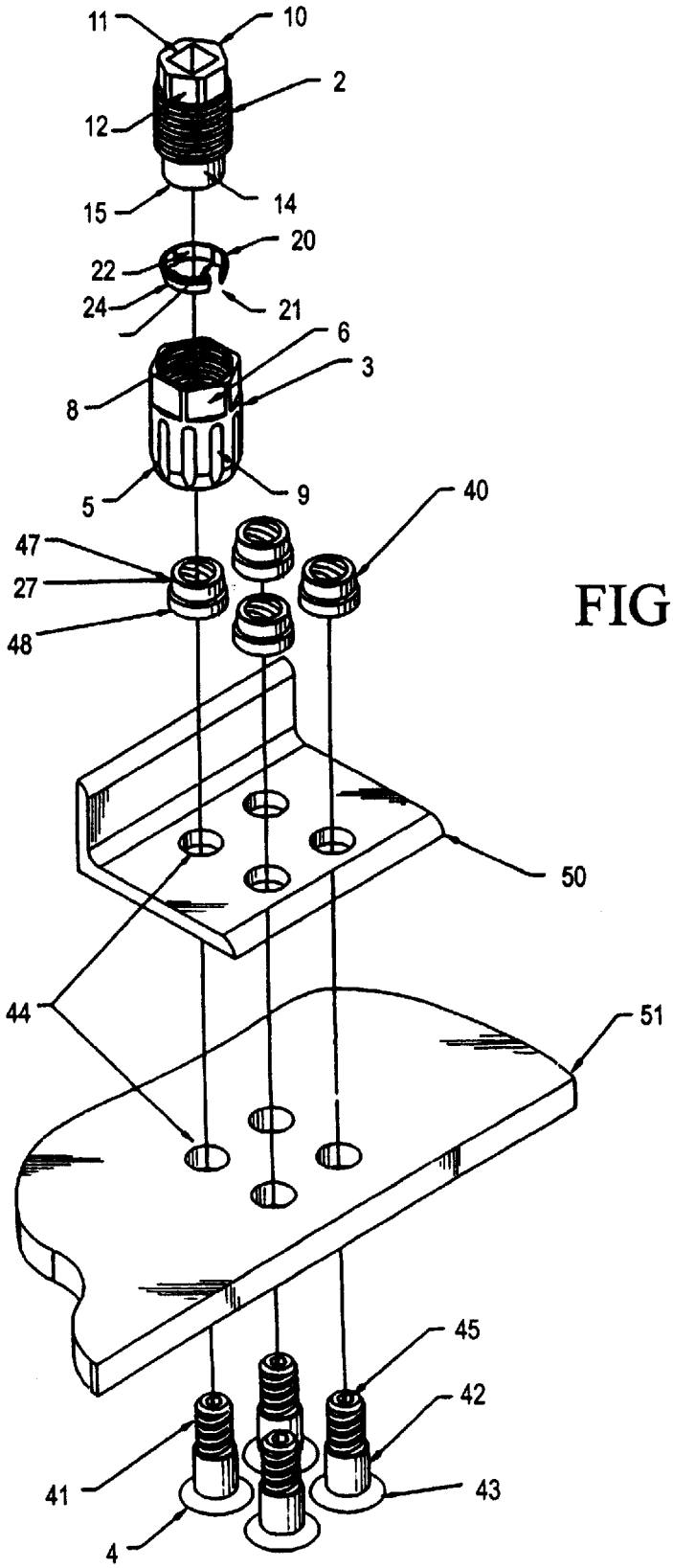
FIG. 2 is a perspective view of the gripping tool detailing the parts thereof and the parts of frangible fastener.
Figure 3:
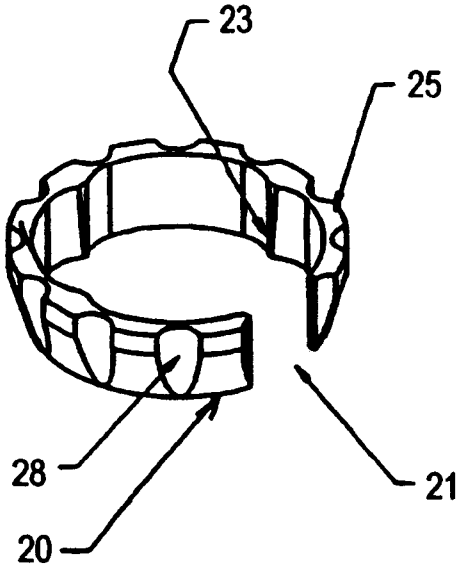
FIG. 3 is a perspective view of the collet.
Figure 7:
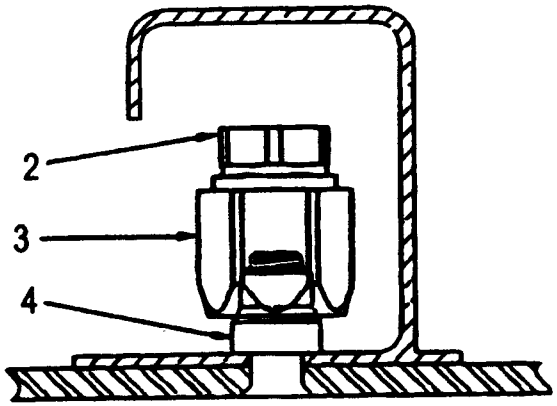
FIG. 7 shows an embodiment of the gripping tool to be used in areas of limited access.
Figure 4:
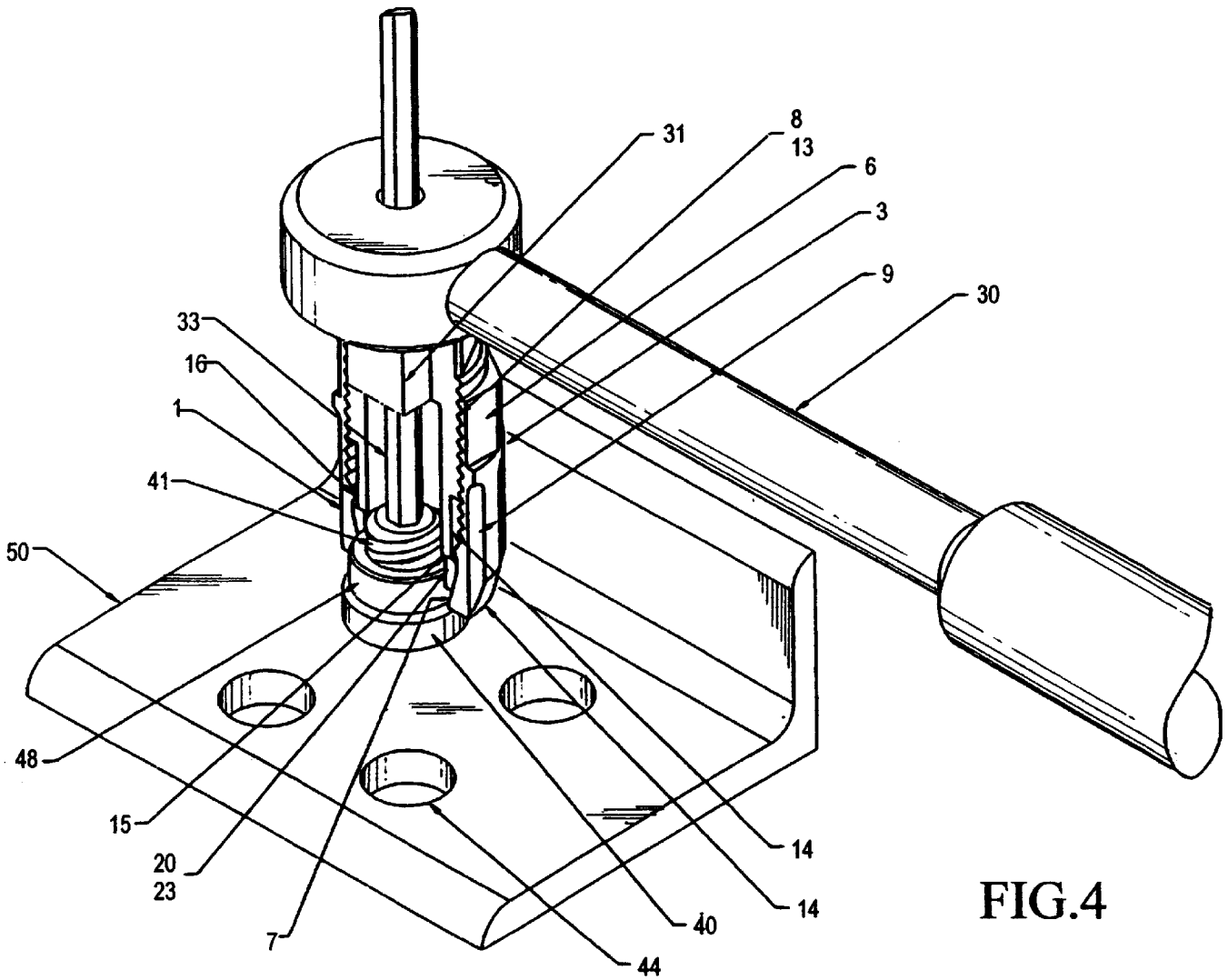
FIG. 4 is a perspective view in partial section of the gripping tool in use with other tools remove the frangible fastener.

Referring to FIG. 2, counter-wise outer threads 13 on the mid-portion of the inner cylinder 2 match counter-wise inner threads 8 of the outer cylinder 3, the cylinders sized so that the inner cylinder 2 can be threaded by rotation within the outer cylinder 3. The counter-wise direction of the threads refers to the direction of the slope of the threads for the fastener 4 to be opened. For example, if the fastener joins part 50 and 51 by a clockwise rotation of the collar 40 along shaft 42 interacting with threaded portion 41 to lock the collar, then the counter-wise outer threads 13 would be counter-clock wise, that is in the opposite direction. This provides the tendency to unlock the collar at the time the tool is used, as will be described in the fullest detail below. If the tool's threads 13 and 8 were in the same direction as the fastener's threaded portion 41, there would be a tendency to tighten the fastener 4 instead of unlocking the fastener 4. While the outer gripping grooves 9 are generally useful, in order to construct a squat version of my tool 1, these may be eliminated. For example, FIG. 7 shows a squat version of my invention with the gripping grooves 9 missing, yet the outer cylinder 3 can be grasped by an open end wrench 32 while the inner cylinder 2 is torqued using another open end wrench.

The outer cylinder shown generally as 3 having a set of standard hexagonal faces 6 form the outer circumference of the top portion of the outer cylinder to receive a standard open or closed head wrench such as 32. Outer gripping groves 9 form the outer circumference of the of bottom portion of the outer cylinder. The hexagonal faces 6 and gripping grooves 9 assists staying the outer cylinder 3 during the initial portion of the removal procedure and to assist the threading of inner cylinder 2 within the outer cylinder 3. The circumferential outer bottom edge 5 of the outer cylinder 3 tapered inward from the surface of the outer cylinder to the bottom rim 17 of the outer cylinder 3 to include a portion of the outer gripping groves 9. The circumferential inner bottom edge 7 (best shown in FIG. 6) also tapers inward for a portion of the outer cylinder 3 to a size smaller than the outside diameter of the collar 40. The tapered portion 27 stops the tool 1 from directly contacting part 50.

The smooth, lower portion area 14 of the inner cylinder 2 extending from the outer threads 13 terminates to flat bottom rim 15. The diameter of the lower portion area 14 of the inner cylinder 2 is sized to impress upon a flat top rim 25, of a nearly circular collet 20 made of hardened material capable of a memory such as spring steel to permit the collet 20 to return to its original shape after deformation. This eases release of the collar after removal from the fastener.

The collet has an outer tapered bottom rim 24 and inner griping teeth 23 raised inward from the inner surface 22 of the collet 20. A gap 21 in the nearly circular configuration of the collet 20 permits the collet to decrease in diameter when urged by the bottom rim 15. Outer linear recesses, or flexibility indentations 28 along the collet surface assists the harden material composing the collet to flex as it surrounds the collar 40. As the inner cylinder 2 is turned counter-wise within the outer cylinder 3, the inner cylinder forces the collet 20 to move through the inner tapered bottom portion 7 of the outer cylinder 3 to close the gap 21 making the collet 20 smaller in diameter and to surround the upset portion 47.

To operate, the tool 1 is placed vertically above the fastener to be removed, bottom rim 17 placed to surround the upset portion 47 of the locked collar 40. The outer cylinder can be held in place by gripping the outer gripping groves 9 or if needed by use of a wrench 32. A hexagonal shaped alien wrench 33 can be used to insert through the center opening of the collar 40 into the recess 45 to keep the fastener shaft 42 from turning as shown in FIG. 1. While holding the shaft 42 with the hexagonal alien wrench 33, the inner cylinder 2 is then torqued counter-wise using an open-end box wrench 32. This will force the inner cylinder 2 to move through the outer cylinder 3 forcing the collet 20 into the inner beveled portion 7 of the outer cylinder 3. The collet 20 continues to move within the beveled portion 7 until the collet completely closes upon the locking upset portion 47 of the collar, the inner gripping teeth 23 impressing upon the collar 40 to prevent slippage. Further torquing of the inner cylinder 2 will translate into a torque movement to the collar 40. Since shaft 42 of the fastener is securely held using the alien wrench 33, the collar 40 unthreads from the threaded portion 41 of the fastener until it is off. The shaft 42 with the collar 40 removed can then be easily removed from the parts 50 and 51.

Further optional features include a flexible cushion of protective material to cover the bottom rim 17 of the outer cylinder to reduce scratching of the part 50 by the tool. The cushion prevents the bottom rim 17 from making direct contact with the part 50, if desired.

Also, flexural assisting grooves aligned along the outer surface of the collet 20 (not shown) enable the collet 20 to flex as it changes in diameter through the tapered section of the outer cylinder. This may assist in the movement of the collet 20 through the tapered portion of the outer cylinder to surround the collar 40, but not necessary.

Figure 8A:
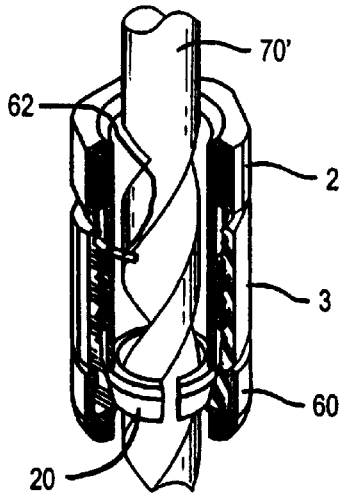
FIG. 8*a* is a partial cut-away perspective view of a drill stop embodiment shown in conjunction with a drill bit.
Figure 8B:
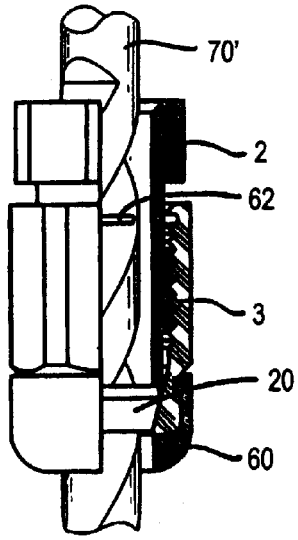
FIG.8*b* is a partial cut-away side elevation of the tool of FIG. 8*a;*
Figure 9A:
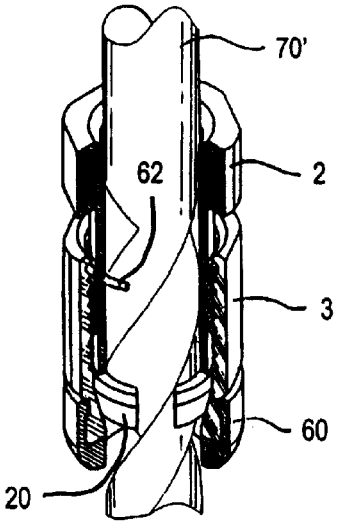
FIG. 9*a* is a partial cut-away perspective view of a drill stop embodiment shown in conjunction with a drill bit having a diameter larger than that shown in FIG. 8*a*.
Figure 9B:
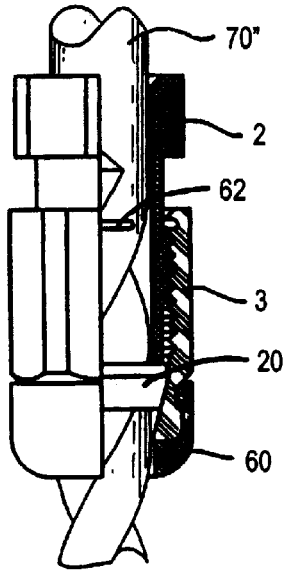
FIG. 9*b* is a partial cut-away side elevation of the tool of FIG. 9*a*.

Referring to FIGS. 8*a*, 8*b*, 9*a*, and 9*b*, the tool 1 is adapted for use as a drill stop. Because the basic functionality of the tool remains the same, i.e., to substantially encompass the periphery of a cylindrical object and grip the same, all previously described components can be used as a drill stop. By rotationally coupling an end stop 60 to the circumferential outer bottom edge 5 of outer cylinder 3, a drill bit can be securely gripped and the material to be drilled protected from abrasive contact with the tool 1. As shown in FIGS. 8*a* and 8*b*, a drill bit 70' can be securely gripped by the tool 1. As shown in FIGS. 9*a* and 9*b*, a drill bit 70", which has a diameter greater than the drill bit 70', can also be securely gripped without having to obtain a different sized drill stop. An optional retaining ring 62 can be used to prevent the unintentional dislocation of the inner cylinder 2 from the outer cylinder 3.

While the above description contains many specifications, they should not be construed as limitations on the scope of the invention, but rather as an exemplification of one preferred embodiment thereof. Accordingly, the scope of the invention should be determined not by the embodiment illustrated, but by the appended claims and their legal equivalents.

What is claimed:

1. A tool for gripping the peripheral surface of a cylindrical object comprising:

an outer cylinder having a first end, a second end, an outer surface and an inner surface wherein the inner surface includes a threaded portion and a frusto-conical portion;

an inner cylinder having a first end, a second end, an outer surface and an inner surface wherein the outer surface includes a threaded portion to engage the outer cylinder threaded portion; and a collet sized to fit within the outer cylinder and having a first end, a second end, an outer surface and an inner surface wherein the outer surface has a generally frusto-conical profile generally complementary to the outer cylinder frusto-conical portion and the collet defines a gap extending from the outer surface to the inner surface, and from the first end to the second end.

2. The tool of claim 1 further comprising a plurality of protrusions formed on the inner surface of the collet.

3. The tool of claim 2 wherein the inner surface of the collet has a constant diameter when in a non-compressed state, wherein the frusto-conical portion of the outer cylinder is adjacent to the second end, and wherein the threaded portion of the inner cylinder is proximate to the first end and the inner cylinder has a reduced diameter outer surface adjacent to the second end, which acts upon the first end of the collet when the inner cylinder is rotated with respect to the outer cylinder.

4. The tool of claim 1 wherein the inner surface of the collet has a constant diameter when in a non-compressed state.

5. The tool of claim 1 wherein the frusto-conical portion of the outer cylinder is adjacent to the second end.

6. The tool of claim 1 wherein the threaded portion of the inner cylinder is proximate to the first end.

7. The tool of claim 6 wherein the inner cylinder has a reduced diameter outer surface adjacent to the second end, which acts upon the first end of the collet when the inner cylinder is rotated with respect to the outer cylinder.

8. The tool of claim 1 further comprising an end stop rotatably coupled to the outer cylinder.

9. The tool of claim 1 wherein the collet is constructed from a material having memory whereby when the radially compressive force is removed, the collet substantially returns to a non-compressed state.

10. The tool of claim 1 further comprising an end stop rotatably coupled to the outer cylinder.

11. A tool for gripping the peripheral surface of a cylindrical object comprising:

an outer cylinder having a first end, a second end, an outer surface and an inner surface wherein the inner surface includes a threaded portion and a frusto-conical portion; and an inner cylinder having a first end, a second end, an outer surface and an inner surface wherein the outer surface includes a threaded portion to engage the outer cylinder threaded portion, and wherein the outer surface of the second end has a generally frusto-conical profile which defines a gap extending from the outer surface to the inner surface.

12. The tool of claim 11 wherein the frusto-conical portion of the outer cylinder has a threaded portion and the second end of the inner cylinder has threaded portion to engage the outer cylinder threaded portion.

13. A method for gripping the peripheral surface of a cylindrical object comprising:

placing a collet having a first end, a second end, an outer surface and an inner surface over the cylindrical object wherein the collet defines a gap extending from the outer surface to the inner surface, and from the first end to the second end to accommodate cylindrical objects of various diameters; and applying a radially compressive force to the collet so as to increase the coefficient of friction between the inner surface of the collet and the cylindrical object.

14. The method of claim 13 further comprising:

surrounding the collet with an outer cylinder wherein the outer cylinder comprises a first end, a second end, an outer surface and an inner surface, the inner surface having a frusto-conical portion at the second end; and urging the collet towards the second end whereby the interaction between the outer surface of the collet and the frusto-conical portion causes generally radial constriction of the collet.

15. The method of claim 14 wherein the collet has a uniform inner diameter and a frusto-conical outer surface profile generally complementary to the frusto-conical portion of the outer cylinder when the collet is disposed in the outer cylinder.

16. The method of claim 14 wherein the urging of the collet towards the second end comprises:

directing an inner cylinder having a first end, a second end, an outer surface having a diameter less than an internal diameter of the outer cylinder at the first end, and an inner surface towards the collect.

17. The method of claim 16 wherein the inner cylinder outer surface includes a threaded portion adapted to engage a threaded portion of the inner surface of the inner cylinder whereby,rotation of the inner cylinder relative to the outer cylinder urges the inner cylinder towards the collet.

18. The method of claim 13 wherein the coefficient of friction is increased by forming protrusions on the inner surface of the collet.

19. A collet comprising:

a first end;

a second end;

an outer surface having a generally frusto-conical profile; and an inner surface wherein the collet defines a gap extending from the outer surface to the inner surface, and from the first end to the second end.

20. The collet of claim 19 further comprising a plurality of protrusions formed on the inner surface of the collet.

* * * * *

UNITED STATES PATENT AND TRADEMARK OFFICE

CERTIFICATE OF CORRECTION

PATENT NO. : 6,401,573 B2
DATED : June 11, 2002
INVENTOR(S) : Travis McClure

It is certified that error appears in the above-identified patent and that said Letters Patent is hereby corrected as shown below:

Column 6,
Line 45, please replace the number "1" with the number -- 7 --
Line 51, Claim 10 is a duplicate of Claim 8. Please delete "Claim 10".

Column 8,
Line 11, please delete the comma between "whereby" and "rotation" and insert a space.

Signed and Sealed this

Twelfth Day of November, 2002

*Attest:*

*Attesting Officer*

JAMES E. ROGAN
*Director of the United States Patent and Trademark Office*